United States Patent [19]

Dilg

[11] 4,364,482

[45] Dec. 21, 1982

[54] APPARATUS FOR CUSHIONING SHOCK FORCES ACTING ON THE UNDERFRAME OF A RAILWAY CAR

[75] Inventor: Walter C. Dilg, Elma, N.Y.

[73] Assignee: Dresser Industries, Inc., Dallas, Tex.

[21] Appl. No.: 166,012

[22] Filed: Jul. 7, 1980

[51] Int. Cl.[3] ..... B61B 9/12

[52] U.S. Cl. ..... 213/8; 213/10; 213/11; 213/45; 213/73

[58] Field of Search ..... 213/7, 8, 10, 11, 44, 213/45, 53, 73

[56] References Cited

U.S. PATENT DOCUMENTS

| | | | |
|---|---|---|---|
| 2,818,982 | 1/1958 | McCafferty et al. | 213/8 |
| 2,950,017 | 8/1960 | Fillion et al. | 213/8 |
| 3,220,561 | 11/1965 | Blake | 213/8 |
| 3,223,049 | 12/1965 | Peterson | 213/8 X |
| 3,257,000 | 6/1966 | Cope | 213/8 |
| 3,712,479 | 1/1973 | Atkinson | 213/8 X |

FOREIGN PATENT DOCUMENTS

| | | | |
|---|---|---|---|
| 132436 | 3/1933 | Fed. Rep. of Germany | 213/8 |
| 416641 | 9/1934 | United Kingdom | 213/8 |

*Primary Examiner*—Randolph Reese

*Attorney, Agent, or Firm*—J. N. Hazelwood; B. E. Deutsch

[57] ABSTRACT

A rigid draft and buffing sliding sill includes cushion elements operably attached thereto for absorbing shocks generated during buff or draft operating conditions. The draft and buffing sliding sill extends lengthwise of the underframe of a railway car. At least one of the cushion elements remains inactive until the shock forces acting on the underframe exceed a predetermined magnitude.

2 Claims, 4 Drawing Figures

APPARATUS FOR CUSHIONING SHOCK FORCES ACTING ON THE UNDERFRAME OF A RAILWAY CAR

BACKGROUND OF THE INVENTION

This invention relates to cushion underframes for use on railway cars, that is, underframes which include a rigid draft and buffing or sliding sill, extending substantially the length of the car and attached at its ends to the car's couplers, the column being movable lengthwise against the resistance of cushion means when forces in buff and draft are applied to the couplers. More particularly, the present invention is concerned with a novel cushion underframe having substantially increased capacity when the magnitude of the shock forces generated during buff or draft conditions exceed a predetermined magnitude.

Cushion underframes have enjoyed wide spread and satisfactory use on various types of railway cars. Cushion underframes include a rigid draft and buffing column or sliding sill extending substantially the length of the car and attached at its ends to the couplers. The sliding sill is movable endwise against the resistance of cushioning means, when forces in buff and draft are applied to the couplers. Cushion underframes have enjoyed commercial success in association with railway car cabooses. When properly tuned, the cushion underframe absorbs the shock forces generated during draft and buffing operations and provides extremely smooth cushioning action at very low reaction to provide maximum comfort for the crew during normal operation of the rolling stock. However, when these cars are subjected to severe impacts, such as those that occur during switching operations, it has been found that the cushioning capacity of the underframe is insufficient to absorb the severe shock forces resulting in violent contact between the solid stops fixed to the sliding and fixed sills of the underframe thereby resulting in damage to these members.

SUMMARY OF THE INVENTION

Accordingly it is an object of this invention to improve cushion underframes.

A further object of this invention is to prevent the stops of the underframe from violently contacting each other when subjected to extraordinary shock forces.

It is a further object of this invention to increase the shock absorbing capacity of a cushion underframe while maintaining riding comfort for the train crew.

It is yet another object of this invention to increase both the shock absorbing capacity and the capability of the sill to absorb kinetic energy generated by it from reactive acceleration of the draft gear restoration force.

These and other objects of the present invention are obtained in a cushion underframe for railway cars having a sliding sill extending lengthwise of the underframe within a fixed or nonmovable sill. The car further includes a pair of spaced body bolsters having aligned openings and extending laterally of the underframe, with the sliding sill passing through the aligned openings and being supported by parts of the bolsters. Cushion means such as draft gears, are disposed substantially adjacent each end of the sliding sill for absorbing shocks generated during buffing or draft operating consitions. First and second stop means are affixed respectively to the sliding sill and to a fixed member of the underframe for preventing lengthwise movement of the sliding sill beyond a first predetermined distance. Additional cushioning means is operably attached to the sliding sill and includes a cushion element first use. Actuating means is associated with the cushion element for activating the element when the sill has moved a predetermined distance for preventing abrupt engagement of the first and second stop elements.

DESCRIPTION OF THE PREFERRED EMBODIMENT

Figure 2:
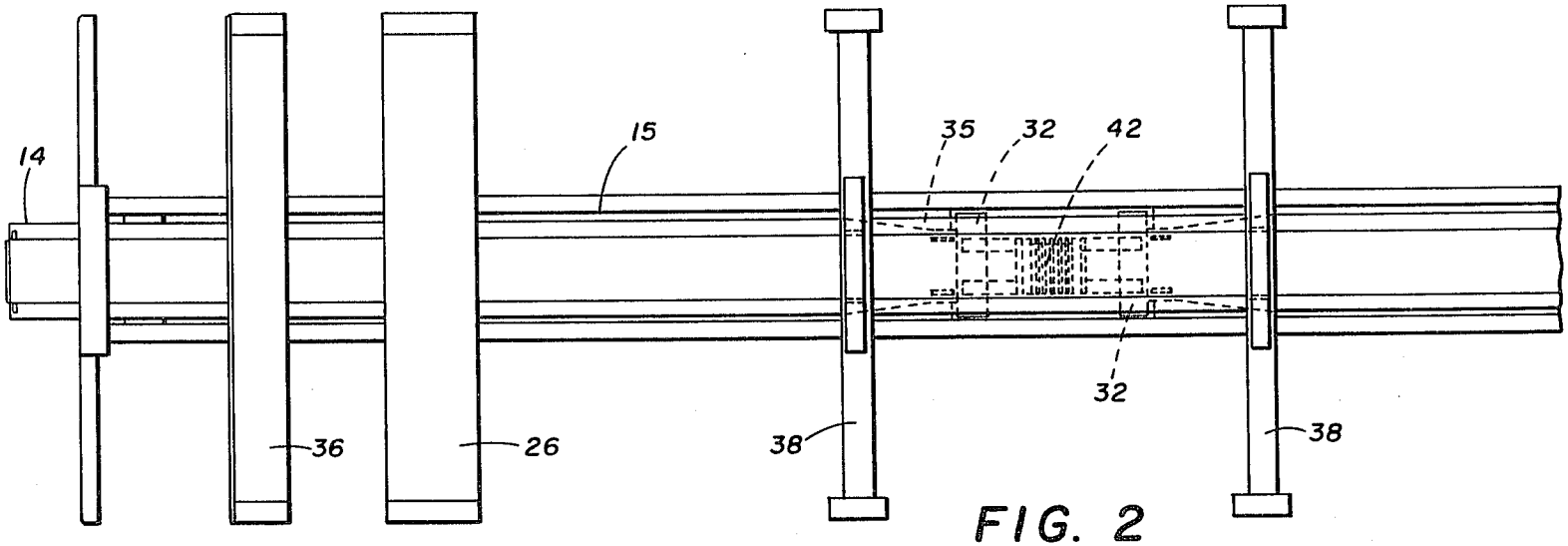
FIG. 2 is a plan view of the cushion underframe illustrated in FIG. 1.

Referring now to the drawings, there is disclosed a preferred embodiment of the present invention. In referring to the various figures of the drawings, like numerals shall refer to like parts.

In the various Figures of the drawings, there is shown a cushion underframe 10 of the type more completely disclosed in U.S. Pat. No. 2,818,982 issued in the name of S. L. McCafferty et al on Jan. 7, 1958. The cushion underframe includes draft and buffing sliding sill 14 extending lengthwise of the underframe. Sliding sill fits within a fixed nonmovable sill 15 of underframe 10. The sliding sill is formed by a pair of Z-bars having their top flanges abutting and secured together as by welding, and their bottom flanges supported upon the bolsters and cross bearers forming the underframe. Couplers 12 (only one being shown and illustrated in phantom in FIG. 1) are located at each end of sliding sill 14, with the shank of each coupler entering the column and being secured in place by means of key 13 in a manner well known to those skilled in the art. At its inner end, the shank of each coupler abuts suitable cushioning unit 16 which may comprise a pair of front and rear followers 17 separated by a group of rubber springs 19. The cushioning unit is supported on carrier plate 21 extending between bottom flanges of sill 14, with the rear follower of each unit abutting an axially aligned stop member 23.

Figure 1:
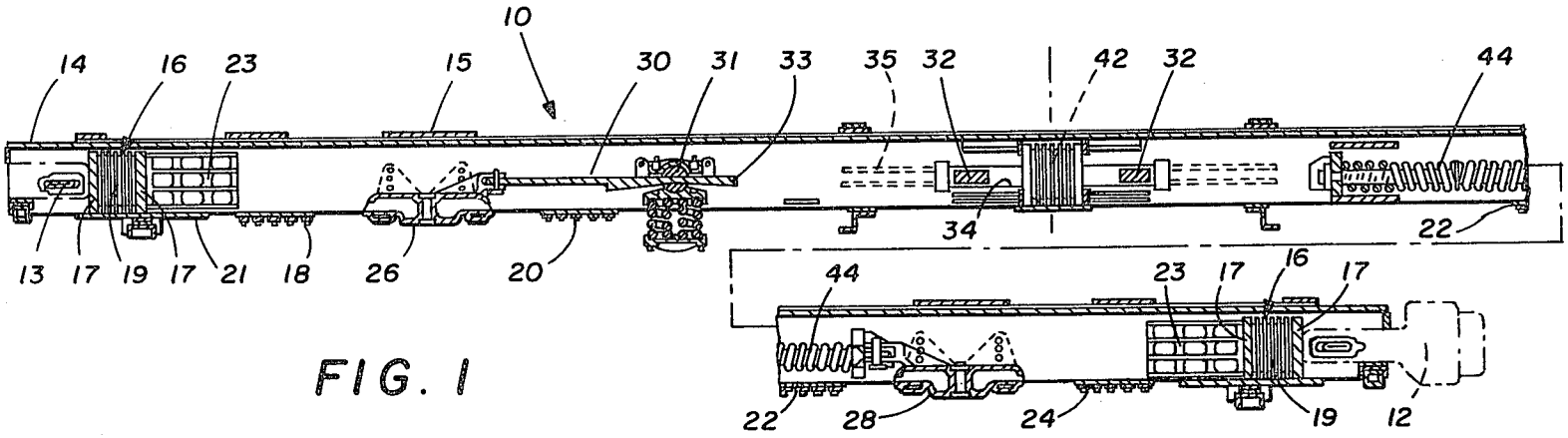
FIG. 1 is a longitudinal sectional view of a cushion underframe including the present invention.
Figure 4:
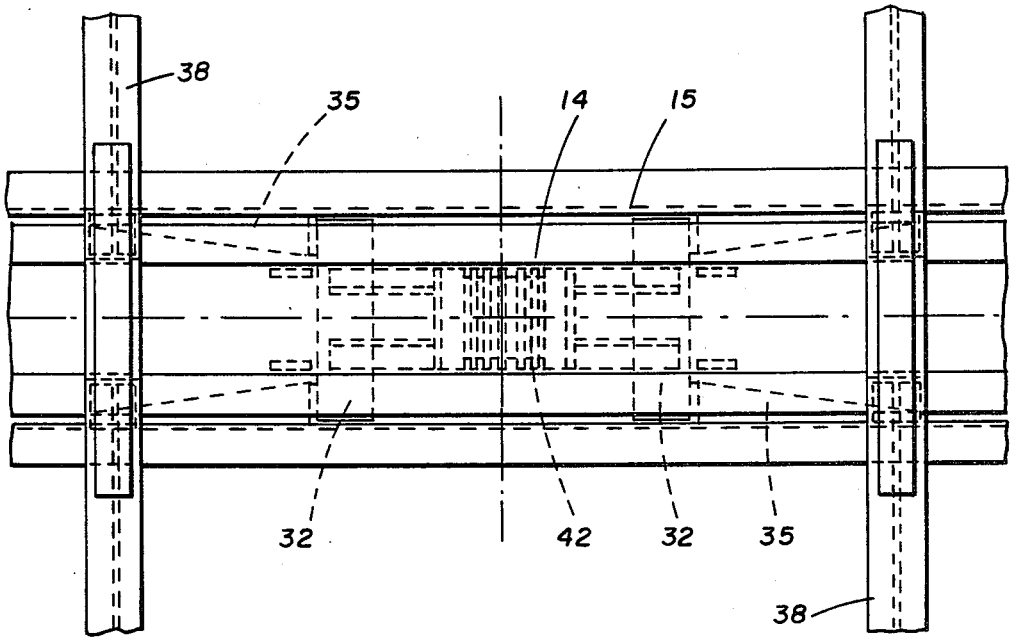
FIG. 4 is a view similar to FIG. 2 further illustrating the enlarged detail shown in FIG. 3.
Figure 3:
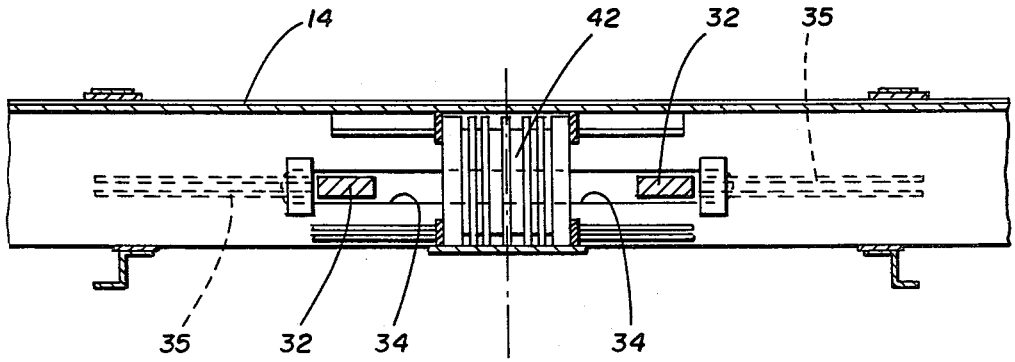
FIG. 3 is a view similar to FIG. 1 showing an enlarged view of a detail of the present invention.

With reference to FIG. 1, underframe 10 includes a pair of body bolsters 26, 28 located towards each end of the underframe. The underframe further includes a number of cross bearers 36, 38 for providing additional lateral support together with the bolsters. The bolsters and cross bearers are of conventional construction. Attached to the underside of sill 14 and movable therewith are stop plates 18, 20, 22 and 24. As will be observed, plates 18 and 20 are spaced equidistantly from either side of bolster 26, while plates 22 and 24 are spaced equidistantly from either side of bolster 28. These plates limit the lengthwise movement of sill 14 in either direction. In effect, when sill 14 has moved a predetermined distance towards the stationary bolsters, the plates will contact portions of the bolsters to prevent further lengthwise movement of the column. In actual use, it has been found that a lengthwise travel of $10\frac{1}{2}$ inches provides a relatively smooth cushioning action.

As shown in FIG. 1, a snubber assembly 30 is operably connected to bolster 26. Snubber assembly 30 comprises a spring loaded shoe 31 engageable with a friction plate 33, with plate 33 being secured to a fixed component of the underframe. Snubber assembly 30 is similar to that disclosed in U.S. Pat. No. 2,950,017 issued Aug. 23, 1960 in the name of S. H. Fillion et al and a detailed explanation thereof is not deemed necessary. Suffice to say, snubber assembly 30 reduces the recoil of sill 14 to a relatively small amount during normal operation of the railway car.

The disclosed underframe further includes a pair of laterally extending plates 32, spaced equidistantly on either side of additional cushioning unit 42. Plates 32 are supported in a fixed position relative to sill 14 on either side of additional cushioning unit 42. Cushioning unit 42 is similar in construction to cushioning unit 16 heretofore described. Wedge shaped support members 35 (four of which are shown in FIG. 2) support plates 32 in the fixed location.

Sill 14 includes a lengthwise extending slot 34, with plates 32 extending into the slot. The function of slot 34 and plates 32 in conjunction with cushioning unit 42 shall be more fully explained hereinafter.

The assembly further includes a return spring 44 for providing a force to return the sill towards its original position once it has been displaced therefrom in a lengthwise direction by the application of either draft or buffing forces.

In operation the cushion underframe of the present invention is designed to absorb shock forces generated during buffing or draft operating conditions. When such forces act upon sill 14, through coupler 12, the sill is moved lengthwise. The lengthwise movement of the sill dissipates the energy imparted thereto from the buffing or draft forces. Additionally, cushioning units 16 provided at either end of sill 14 further absorb shock forces generated during normal buffing operation. However, when the couplers, and thus, the sill are subjected to excessive forces such as are developed during yard switching operations, the sill will move excessively in a lengthwise direction so stop plates 18 or 22, if the sill is moved from left to right as viewed, or stop plates 20 and 24 if the sill is moved from right to left, will abruptly strike the stationary bolsters to prevent further movement of the sill. The abrupt and violent contact between the plates and bolsters have in some cases resulted in shearing of the plates with consequent maintenance required to repair the damaged underframe.

To prevent undesirable abrupt contact between the stop plates and bolsters, lateral plates 32 have been provided on either side of cushioning unit 42 at a distance somewhat less than the distance separating stop plates 18, 20, 22 and 24 from their respective bolsters. For example, it has been noted heretofore that the stop plates are spaced from the bolsters approximately $10\frac{1}{2}$ inches. Accordingly, lateral plates 32 are spaced from each end of cushioning unit 42 a distance of approximately 8 inches. Slot 34 provided in sill 14 permits relative movement between the sill and the plates; however, when the sill has moved a distance of 8 inches in either direction, the end of cushioning unit 42 will contact the respective plate with further movement of the sill in the same direction resulting in cushioning unit 42 being compressed by the stationary plate. By utilizing additional cushioning unit 42, stop plates 18, 20, 22, and 24 will be prevented from abruptly and violently contacting their associated bolsters. In effect, cushioning unit 42 is generally inactive and only becomes active to provide a further cushioning force or additional cushioning capacity when the sill has been moved excessively in a lengthwise direction due to forces of an unusually large magnitude. Activation of cushioning unit 42 results in yieldable or cushioned engagement between the respective stop plates. It is desirable to maintain the cushioning action as low as possible to provide relatively smooth cushioning action with very low reaction during normal operation of the railway car. However, in cases when the magnitude of the draft or buffing forces become excessive, it is then necessary to increase the cushioning action of the underframe to accommodate the excessive forces.

It should be noted that the initial excessive buffing or draft forces which have heretofore resulted in excessive lengthwise movement of the sill, have also resulted in excessive reactive movement of the sill due to the kinetic energy imparted thereto. In effect, the rebound of the sill towards its original position has been a major cause of damage to the stop plates. Since plates 32 are provided on either side of cushioning unit 42, the cushioning means becomes effective during movement in either direction of the sill and thus would not only cushion original forces imparted to the sill, but will further cushion the restoration forces. To obtain maximum benefits for the invention, preferably cushioning unit 42 is located at the lengthwise center of sill 14. The initial 8 inches of travel permitted sill 14 provides good quality cushioning for normal road service operation, with the last $2\frac{1}{2}$ inches of travel wherein cushioning unit 42 becomes active, providing additional cushioning capacity to protect the car from high speed impacts due to yard switching or similar generation of excessive draft or buffing forces.

While a preferred embodiment of the present invention has been described and illustrated, the invention should not be limited thereto but may be otherwise embodied in the scope of the following claims.

The embodiments of the invention in which an exclusive property or privilege is claimed are defined as follows:

1. A cushion underframe for railway cars comprising:

a pair of spaced bolsters extending laterally of the car and having aligned openings;

a fixed sill extending lengthwise of the car through said aligned bolster openings;

a movable sill disposed within said fixed sill and extending lengthwise of the car through said aligned bolster openings, said movable sill being movable relative to said fixed sill lengthwise of said car;

cushion means disposed substantially adjacent each end of said sill for absorbing shocks generated during buff operating condition;

low reaction cushion element affixed to said movable sill and operable during initial increments of the sill's movement to cushion longitudinal shock forces applied to said sill;

stop means including a first plate attached to said movable sill on one side of a bolster and a second plate attached to the sill on the other side of the bolster equidistant from the first plate for limiting maximum lengthwise travel of said sill relative to said bolster;

additional cushion means attached to said movable sill and located at approximately the longitudinal center thereof;

means defining a pair of elongated slots formed in the movable sill on either side of said additional cushion means; and first and second follower members affixed to said fixed sill, with a first follower member extending within one of said slots and a second follower member extending within the other of said slots, the distance between said follower members and said cushion element being less than the distance between the stop means plates and bolster, with engagement between one of said follower members and said additional cushion means cushioning the impact force between said stop means and said bolster.

2. The invention of claim 1 wherein said additional cushion means is brought into engagement with first follower member upon lengthwise movement of said sill in a first direction to generate a cushioning force, with movement of said sill generating a restoration force operable to move the sill lengthwise towards its initial position, said additional cushion means thereby engaging said other follower member for generating a further cushioning force to cushion the restoration force generated by the sill.

* * * * *